US006516769B2

(12) United States Patent
McArthy

(10) Patent No.: US 6,516,769 B2
(45) Date of Patent: Feb. 11, 2003

(54) VALVE SEAL ASSEMBLY WITH DUAL FINGER RETAINER SYSTEM

(75) Inventor: Troy Daniel McArthy, Auburn, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/792,971

(22) Filed: Feb. 26, 2001

(65) Prior Publication Data

US 2002/0117140 A1 Aug. 29, 2002

(51) Int. Cl.[7] ..... F02N 3/00
(52) U.S. Cl. ..... 123/188.6
(58) Field of Search ..... 123/188.6, 188.8, 123/188.04, 188.9 C; 277/33, 38, 125, 124, 181, 184, 187, 152

(56) References Cited

U.S. PATENT DOCUMENTS

| | | | | |
|---|---|---|---|---|
| 2,878,799 A | | 3/1959 | Brenneke | 123/188.6 |
| 2,926,938 A | | 3/1960 | Ratti | 277/576 |
| 4,730,583 A | | 3/1988 | Stritzke | 123/188.6 |
| 4,834,037 A | | 5/1989 | Lafever | 123/188.6 |
| 4,947,811 A | | 8/1990 | Binford | 123/188.6 |
| 5,553,869 A | | 9/1996 | Stamback | 277/33 |
| 5,775,284 A | * | 7/1998 | Krichner et al. | 123/188.6 |
| 5,975,538 A | * | 11/1999 | Krause et al. | 277/551 |

* cited by examiner

*Primary Examiner*—Gene Mancene
*Assistant Examiner*—Hyder Ali
(74) *Attorney, Agent, or Firm*—Rader, Fishman & Grauer PLLC

(57) ABSTRACT

A valve stem seal assembly incorporates a cylindrical valve stem seal retainer having an axis and an upper end about which symmetrically and circumferentially arranged, alternating upper and lower fingers have depending ends which lie in two distinct planes in one preferred embodiment. The lower fingers depend radially inwardly toward the axis from the cylindrical body of the retainer to provide for axial securement of an elastomeric seal body to the top of a valve guide. The upper fingers extend axially upward from the same end, in the form of a gooseneck, and are adapted to apply a circumferential, radially inwardly directed spring force to the elastomeric seal body. The upper fingers are thus effective to eliminate the garter retainer springs used with conventional seal bodies of traditional valve stem seal assemblies.

12 Claims, 1 Drawing Sheet

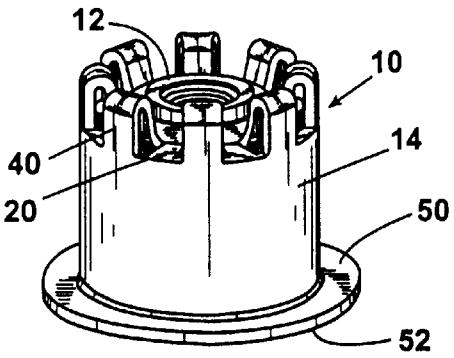
Fig. 1
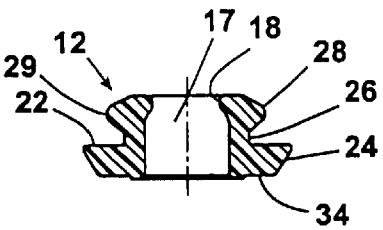
Fig. 2
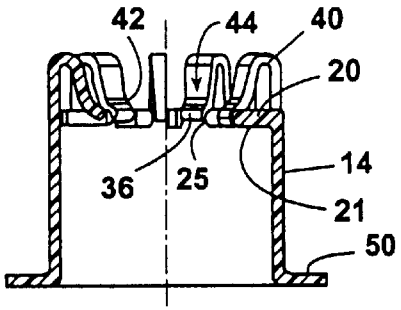
Fig. 3
Fig. 4
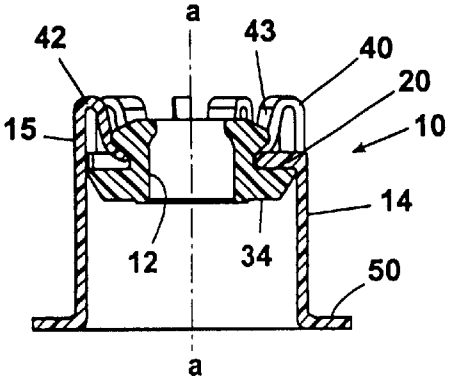
Fig. 5
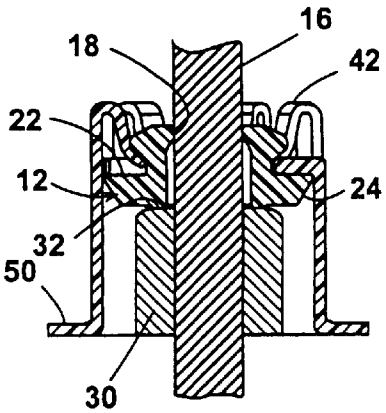
Fig. 6

VALVE SEAL ASSEMBLY WITH DUAL FINGER RETAINER SYSTEM

BACKGROUND OF THE INVENTION

1. Field of Invention

The present invention relates to valve stem seal assemblies for use in internal combustion engines, and more particularly to sealing media retainers for such seal assemblies.

2. Description of the Prior Art

Those skilled in the art will appreciate the manner in which intake and exhaust valves are employed in cylinder heads of internal combustion engines. Such valves, supported for reciprocal motion within valve guides, include integral elongated stems extending away from the engine cylinder heads, the ends of the stems interacting with rotating cams for cyclic repeated opening and closure of the valves against the force of valve return springs during the combustion cycle. Obviously, in order to permit unobstructed reciprocal movement of the stem in the guide, some mechanical clearance must exist between the valve guide and the moving stem. The valve stems thus move reciprocally to and from the cylinder head, each within its individual guide, and so-called valve stem seal assemblies are used to seal against leakage of oil through a clearance path between each annular engine valve guide and an associated valve stem.

Thus, and as is well known, the intake port of a combustion chamber is opened and closed by the reciprocating motion of at least one intake valve, which in turn is driven by the rotary motion of a cam, the latter being affixed to and rotatable with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of similar construction and both include stems integrally affixed to the valves.

In the typical engine, a valve stem seal assembly is fitted over or atop each valve guide, wherein each assembly has a retainer frictionally mounted to an associated valve guide, or is retained in place via cooperation of a return spring and a retainer flange, to assure securement of the assembly within the engine. Typically each valve stem seal assembly has two primary parts; 1) an elastomeric oil seal positioned at one end to control leakage of oil between the valve stem and guide as noted, and 2) a structural cylindrical part called a retainer mounted atop of the valve guide. In many cases, the retainer has a so-called bottom flange that extends circumferentially about the bottom of the valve guide for supporting the retainer on the cylinder head deck. As those skilled in the art will appreciate, the cylinder head deck provides support for the bottom flange on which the noted valve return springs bear.

Much progress has been achieved in the art of valve stem seal assembly design and construction. However, several design issues remain problematic for traditional valve stem seal assemblies. For example, the number of parts associated with a valve stem seal assembly has typically been at least the two described: 1) the seal body, and 2) the retainer. However, more often than not, a third part called a "garter spring" is disposed within a circumferential groove about the exterior of the seal body to impart a hoop stress or force to the circumferential sealing lip. One common concern related to the garter spring is that it tends to lose its resilience over a period of time, often short of the useful life of the valve stem seal assembly. Another issue is cost of this typically spring metal part.

The present invention operates to alleviate these issues.

SUMMARY OF THE INVENTION

The present invention provides a two-piece valve stem seal assembly for an internal combustion engine. A plurality of such assemblies is contemplated for use in an engine, each assembly designed for insertion over each engine valve guide. Each assembly is adapted for continuous engagement with an associated reciprocally movable valve stem. The elastomer seal body incorporates an interior circumferential aperture containing at least one radially inwardly directed sealing lip adapted to engage the stem to minimize escape of oil lubricant from the engine along a path between the valve guide and the reciprocally movable valve stem seal. The retainer includes a dual finger system for performing two separate functions. Thus, upper and lower sets of circumferentially disposed fingers depend radially inwardly from the cylindrical retainer body, each set of fingers functioning independently of the other, and each set being axially offset from the other. In one preferred form the lower fingers operate to assure retention of the seal body to the top of the valve guide, while the upper fingers, each formed in the shape of a goose neck, extend resiliently against the valve stem seal body to assure that a continuously applied, radially inwardly directed force is applied to the reciprocally moving stem. In one preferred form the lower and upper sets of fingers are adapted to share a common groove disposed about the elastomeric seal body. Finally, to the extent that a more robust and dependable resilient system is offered by this invention, the upper fingers avoid dependence on, and thus fully eliminate, any need for a traditional garter retention spring.

BRIEF DESCRIPTION OF THE DRAWINGS

FIG. 1 is a perspective view of one preferred embodiment of the valve stem seal assembly of the present invention.

FIG. 2 is cross-sectional view of the resilient elastomeric seal body of the valve stem seal assembly of FIG. 1, depicting particular construction details of the seal body.

FIG. 3 is a cross-sectional view of the seal body retainer along lines 3—3 of FIG. 4, depicting dual sets of fingers as employed in the described preferred embodiment of the present invention.

FIG. 4 is a plan view of the retainer of the described preferred embodiment, revealing particular construction details of the two sets of alternating fingers.

FIG. 5 is a cut-away view of the valve stem seal assembly depicted in FIG. 1, revealing cross-sectional views of the connective relationship between the elastomeric seal body and the metallic seal body retainer incorporated in the preferred embodiment.

FIG. 6 is an identical cross-sectional view of the seal assembly of FIG. 5, shown however in sealing engagement with a valve stem in accordance with the contemplated usage of the present invention in an internal combustion engine, and particularly showing the seal assembly supported atop a valve guide through which the valve stem is reciprocally moveable.

DETAILED DESCRIPTION OF THE PREFERRED EMBODIMENTS

Referring initially to FIGS. 1–5, a valve stem seal assembly 10 is constructed to include a resilient elastomeric seal body 12 supported in a rigid cylindrical seal body retainer 14. The resilient seal body 12 is generally annular in shape, and includes interior and exterior surfaces 17 and 29, respectively. Within its interior surface 17, the seal body 12 incorporates a circumferentially extending sealing lip 18 for purposes to be described. The body 12 is supported within the retainer 14 by a plurality of retainer fingers 20 and 40, arranged alternately in two circumferentially radially inwardly extending sets as will be further described. The individual ends 25 and 36 of the respective sets of fingers 20 and 40 collectively extend into a circumferential exterior groove 26 of the seal body 12, as particularly depicted in the cut-away portion of FIG. 5. The groove 26 of the seal body 12 lies intermediate an integral upper bulbous ring 28 and an integral lower body flange 24.

Referring now specifically to FIGS. 3 and 5, it will be noted that the respective ends 25 and 36 of the fingers 20 and 40 are axially offset from each other along axis a—a by a small distance in the preferred embodiment described. Depending on the physical geometry of the seal body 12, the actual offset distance can vary from 0 to several millimeters.

Referring now to FIGS. 3 and 6, the first set of fingers 20 are the lower of the two sets 20 and 40 as described in the preferred embodiment herein. The fingers 20 have bottom surfaces 21 which overlie the upper surface 22 of the flange 24 of the seal body 12. As such, the fingers 20 are designed to retain or hold the seal body 12 in place atop the annular upper surface 32 of the valve guide 30.

Referring now to FIGS. 2, 3, 5, and 6, the bulbous ring 28 of the seal body 12 has a circumferential exterior 29 as previously noted. Each of the second set of fingers 40 extends axially upwardly from the circumferential sidewall 15 of the seal body retainer. Each finger 40 has a reverse bend or goose neck 42 that defines its axially uppermost extremity. A downwardly depending leg 43 depends radially inwardly from each gooseneck 42. The legs 43 have arcuate ends 36 which collectively form a cup-shaped, external support 44 for the circumferential exterior surface 29 of the bulbous ring 28 as shown. The effect of the collective support 44 is the application of a circumferential hoop stress or force to the sealing lip 18 for urging the lip against the exterior surface of the reciprocating valve stem 16.

It will be appreciated by those skilled in the art that manufacture of the seal body retainer 14 can be achieved in a variety of ways. Referring to FIGS. 4 and 5, it will be apparent that both first and second sets of fingers are circumferentially and symmetrically arranged about the axis "a—a". In the embodiments herein described it is, however, preferable that the fingers 20 and 40 have circumferential spacing or gaps 41 between them. The gaps 41 are for the purpose of avoiding frictional interference between movements of adjacent fingers 20 and 40 during the working or useful life of the valve stem seal assembly 10. The gaps 41 can be of a relatively small order of magnitude, as will be appreciated by those skilled in the art. In addition, this invention will accommodate other circumferential arrangements of the fingers 20 and 40. Thus for example, the fingers could be arranged so that there are two fingers 20 positioned side-by-side followed by two fingers 40 side-by-side. Such modified arrangement as well as others are deemed herein to be feasible, notwithstanding the described preferred embodiment which provides the circumferentially alternating choice of finger 20, finger 40, finger 20; i.e. wherein each finger of the first set is bordered on each side by one finger of the second set as depicted in FIGS. 1 and 3–6.

Those skilled in the art will also appreciate that the seal body retainer 14 includes a circumferential bottom flange 50 that provides support for valve return springs not shown. The bottom surface 52 of the flange 50 engages the top surface of a cylinder head deck, also not shown, from which the valve guide 30 extends.

Finally, although the described embodiments of this invention contemplate that the retainer 14 is formed of metal, other materials may be suitable depending upon the harshness of the particular engine environment. For example, some glass-filled nylons or other plastics may be suitable in some environments. Obviously, in such cases the retainer might suitably be formed of plastic materials.

It is to be understood that the above description is intended to be illustrative and not limiting. Many embodiments will be apparent to those of skill in the art upon reading the above description. Therefore, the scope of the invention should be determined, not with reference to the above description, but with reference to the appended claims, along with the full scope of equivalents to which such claims are entitled by law.

What is claimed is:

1. A valve stem seal assembly adapted for installation atop of a valve guide of an internal combustion engine for sealingly engaging a valve stem reciprocally movable through the guide, the seal assembly comprising a resilient annular seal body defining an upper bulbous ring having an interior annular sealing lip adapted to engage the valve stem, said seal body also defining an exterior annular groove; said valve stem seal assembly further comprising a seal body retainer defining a generally rigid cylindrical body and having an axis, said retainer having a circumferentially extending annular flange at its lower body end, said retainer having a plurality of fingers at its upper body end, each of said fingers belonging to one of two distinct sets of fingers thereof, wherein the first set comprises radially inwardly depending fingers for engaging said exterior annular groove of said seal body to maintain said seal body axially against the top surface of the valve guide, and wherein the second set comprises axially extending reversely bent fingers having arcuate ends that collectively engage the circumferential exterior surface of said bulbous ring of the seal body to impart a circumferential hoop force to said sealing lip for urging same against said reciprocally movable valve stem.

2. The valve stem seal assembly of claim 1 wherein said seal body further comprises a lower circumferential flange wherein said groove defines an axial spacing between said bulbous ring and said flange.

3. The valve stem seal assembly of claim 2 wherein said flange defines a bottom surface adapted to sealingly engage said top of said valve guide.

4. The valve stem seal assembly of claim 3 wherein said first and second sets of fingers are circumferentially alternating, such that each finger of the first set is bordered on each side by one finger of the second set.

5. The valve stem seal assembly of claim 3 wherein said second set of fingers are goose-necked to define a resilient cup-shaped, external support for said bulbous ring.

6. The valve stem seal assembly of claim 5 wherein said second set of fingers have arcuate ends which comprise said cup-shaped external support for said bulbous ring.

7. The valve stem seal assembly of claim 3 wherein both of said first and second sets of fingers are circumferentially and symmetrically arranged about said axis.

8. The valve stem seal assembly of claim 6 wherein said fingers of respective first and second sets are axially offset from each other.

9. The valve stem seal assembly of claim 2 wherein said seal body comprises an elastomeric material.

10. The valve stem seal assembly of claim 8 wherein said sets of said first and second fingers are axially offset and circumferentially alternating with respect to each other.

11. The valve stem seal assembly of claim 1 wherein said retainer is comprised of metal.

12. The valve stem seal assembly of claim 1 wherein said retainer is comprised of plastic material.

* * * * *